United States Patent [19]

Muench et al.

[11] Patent Number: 5,021,615

[45] Date of Patent: Jun. 4, 1991

[54] ON/OFF LOADBREAK SWITCH

[75] Inventors: Frank J. Muench, Waukesha; William B. McFarlin, Wauwatosa, both of Wis.

[73] Assignee: Cooper Power Systems, Inc., Houston, Tex.

[21] Appl. No.: 414,445

[22] Filed: Sep. 29, 1989

[51] Int. Cl.[5] ..... H01H 19/10; H01H 21/18

[52] U.S. Cl. ..... 200/11 TC; 200/15

[58] Field of Search ..... 200/8 R, 8 A, 11 R, 200/11 D, 11 G, 11 J, 11 TC, 11 B, 14, 15, 144 R

[56] References Cited

U.S. PATENT DOCUMENTS

| | | | |
|---|---|---|---|
| 1,945,459 | 1/1934 | Whittingham | 200/15 |
| 3,316,367 | 4/1967 | Kowalski | 200/15 |
| 3,461,259 | 1/1968 | Leonard et al. | 200/441 |
| 3,590,183 | 6/1971 | Leonard | 200/441 |
| 4,138,602 | 2/1979 | Eley | 200/440 |
| 4,399,336 | 8/1983 | Greve | 200/11 R |
| 4,412,116 | 10/1983 | Golub | 200/571 |
| 4,518,838 | 5/1985 | Werner | 200/303 |
| 4,532,386 | 7/1985 | Muench, Jr. et al. | 200/11 TC |
| 4,683,353 | 7/1987 | Wu et al. | 200/10 X |
| 4,778,961 | 10/1988 | M'Sadoques et al. | 200/15 X |

*Primary Examiner*—J. R. Scott

*Attorney, Agent, or Firm*—Michael, Best & Friedrich

[57] ABSTRACT

A switch apparatus including a main housing, a fixed contact supported by the main housing, a shaft supported by the main housing for pivotal movement relative thereto, a movable contact supported by the shaft for common movement therewith, and a motor assembly for moving the shaft relative to the main housing between a closed position wherein the movable contact engages the fixed contact and an open position wherein the movable contact is spaced from the fixed contact. The shaft consists of two opposite halves mating along a longitudinally extending plane. The fixed contact may consist of two opposed spring-biased contact portions mounted in the housing.

20 Claims, 5 Drawing Sheets

ON/OFF LOADBREAK SWITCH

BACKGROUND OF THE INVENTION

The invention relates to on/off loadbreak switches, or to "quick-make and quick-break" switches. Such switches are typically used in distribution transformers and are immersed in transformer oil. See, for example, U.S. Pat. Nos. 3,590,183, 4,412,116, and 4,532,386.

SUMMARY OF THE INVENTION

The invention provides an improved on/off loadbreak switch. The switch comprises a housing including three substantially identical sections. The use of housing sections facilitates assembly of the switch, as will be explained hereinafter. The switch also comprises six fixed contact assemblies, with two contact assemblies being mounted in opposed, facing relation on each of the housing sections. Each contact assembly includes a copper spacer, a stack of copper shims mounted on one side of the spacer, and a stack of copper shims mounted on the other side of the spacer so that the shim stacks are spaced from each other. Copper shims are preferred over solid copper members because shims are more flexible and do not work harden as quickly. Each shim stack has thereon an arc-resistant Pad facing and spaced from the Pad on the other shim stack. This pad is mounted to a rivet which clamps the shim stack and a steel backing member mounted on the outer surface (the surface facing away from the spacer) of the shim stack together after it is riveted in place. It has been determined that the steel amplifies or concentrates magnetic flux and thereby clamps the shim stacks together when high fault currents are flowing through the contacts. Each contact assembly further includes a spring arrangement for biasing the backing members, and thus the shim stacks, toward each other. The spring arrangement includes a post having enlarged ends and extending through the backing members, the shim stacks and the spacer. The spring arrangement also includes a compression spring extending between one end of the post and one of the backing members. The other end of the post engages the other backing member. The spring acts through the post to bias the shim stacks against the spacer or toward each other. Preferably, the spring of each contact assembly is housed in a respective pocket in the associated housing section. This protects the spring from arcing.

The switch also comprises a shaft or rotor supported by the housing for pivotal movement relative thereto about an axis. The shaft includes two substantially identical halves split along a plane having therein the shaft axis. In other words, the shaft is split longitudinally. The shaft halves are secured together by bolts, screws or other suitable means. The use of identical halves reduces manufacturing costs.

The switch further comprises three contact blades captured or sandwiched between the shaft halves. The contact blades are spaced longitudinally of the shaft and are spaced apart the same distance as the fixed contact assemblies are spaced apart. Each blade is aligned with a pair of contact assemblies. Preferably, the shaft halves have thereon deformable or crushable projections that are crushed against the contact blades when the blades are sandwiched between the shaft halves. This provides a tight fit between the blades and the shaft halves and thereby substantially prevents lateral movement of the blades relative to the shaft.

The switch further comprises an over-center spring device or motor assembly for pivoting the shaft relative to the housing. The motor assembly moves the shaft between a closed position in which each contact blade engages the aligned pair of contact assemblies and an open position in which the contact blades are disengaged from the contact assemblies. Preferably, the shaft moves approximately 90° between the closed position and the open position.

The switch is assembled by sandwiching the contact blades between the shaft halves and securing the resultant shaft and contact assembly to the motor assembly. Next, the housing sections are placed over the shaft or are located in surrounding relation to the shaft and contact assembly. This is done by passing the shaft and contact assembly through openings in the housing sections. Next, the shaft is moved to the closed position and the contact blades are placed in engagement with their respective fixed contact assemblies. This properly aligns the housing sections relative to the shaft and contact assembly. Next, the housing sections are secured relative to each other and relative to the motor assembly.

This method of assembly permits the housing sections to be properly aligned with the shaft and contact assembly. This in turn substantially assures that the contact blades will properly engage the fixed contact assemblies when the shaft is moved to the closed position.

One advantage of the spring arrangement is that it compensates for unexpected misalignment of the contact blade and the fixed contact assembly. In other words, both pads will still be biased against the contact blade even if the contact blade is not perfectly Positioned between the pads but is located closer to one of the pads. Also, the coil spring provides a more consistent force than would be provided by leaf springs.

Other features and advantages of the invention will become apparent to those skilled in the art upon review of the following detailed description, claims and drawings.

Figure 1:
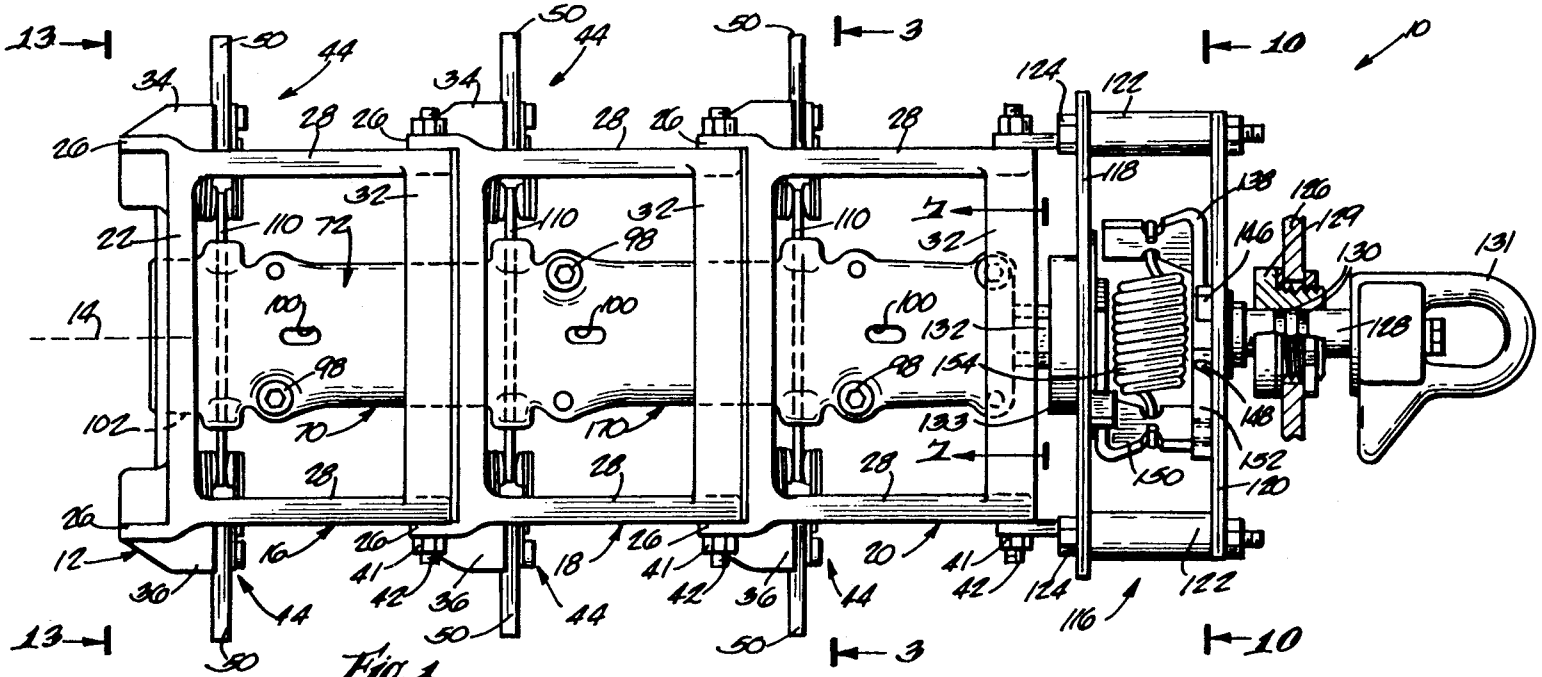
FIG. 1 is an elevational view of a loadbreak switch embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A loadbreak switch 10 embodying the invention is illustrated in the drawings. Although a three-phase switch is shown, it should be understood that the invention is equally applicable to single-phase switches, or to switches having any number of contacts.

Figure 4:
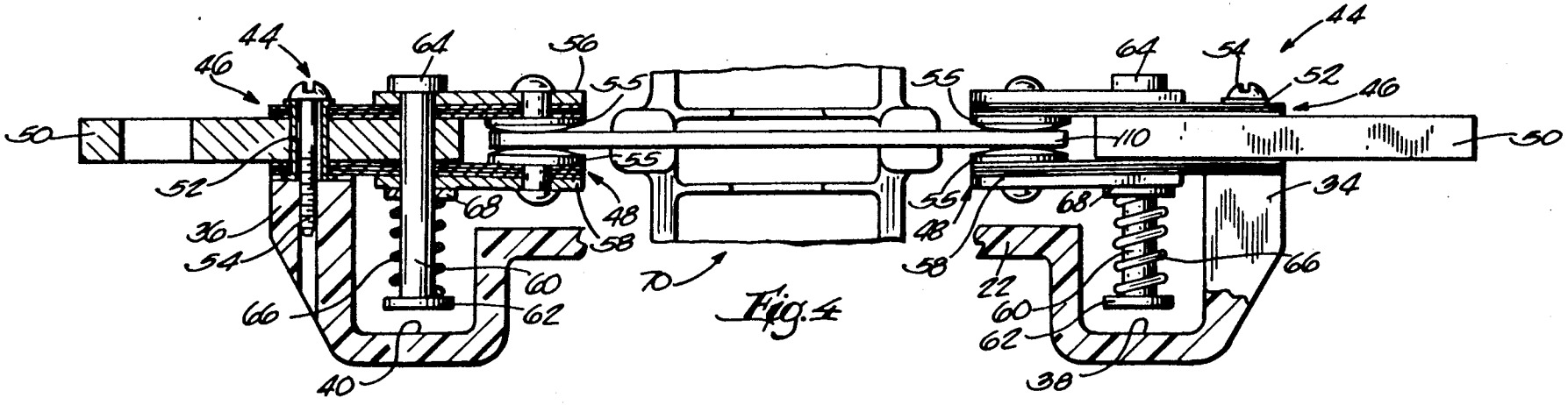
FIG. 4 is a view taken along line 4—4 in FIG. 3.
Figure 13:
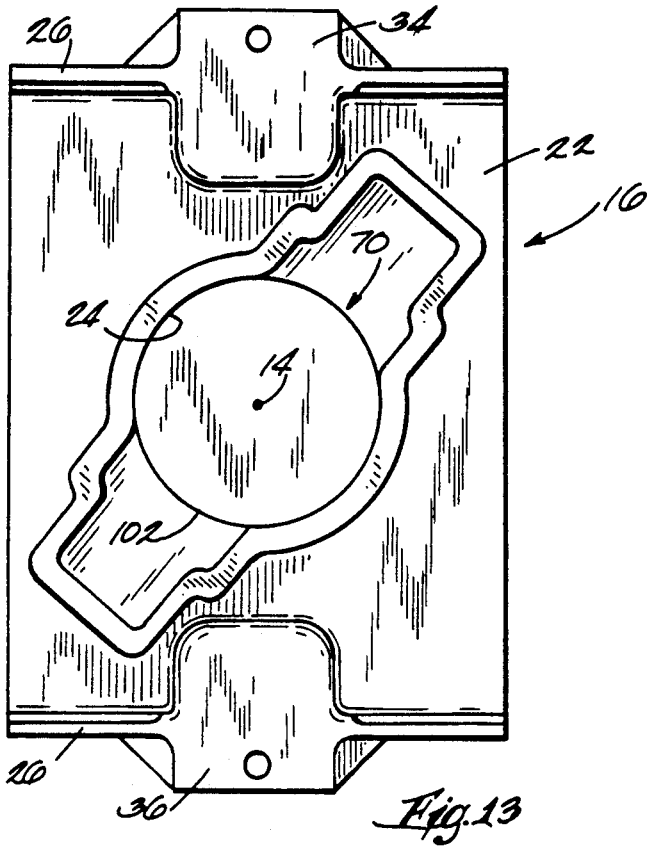
FIG. 13 is a view taken along line 13—13 in FIG. 1.
Figure 14:
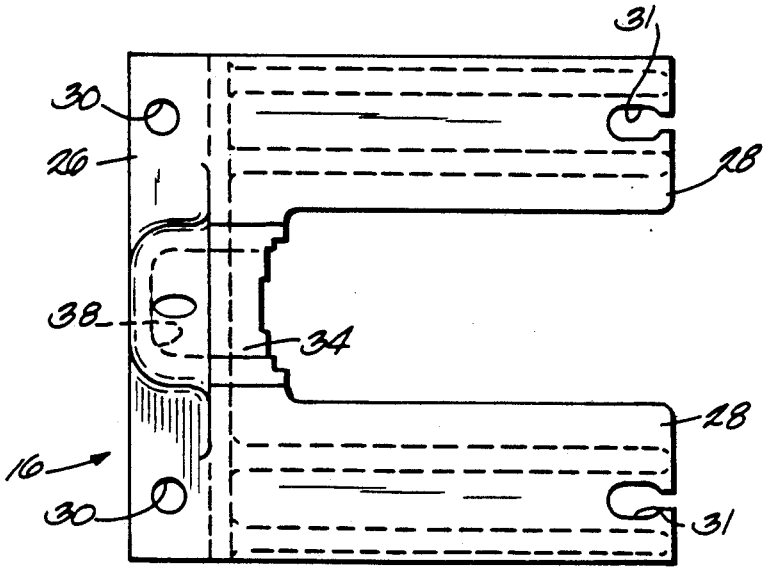
FIG. 14 is a plan view of one of the housing sections.

The switch 10 comprises (see FIG. 1) a housing 12 which has a longitudinal axis 14 and which, in the preferred embodiment, includes an end section 16, a middle section 18, and an end section 20. The sections 16, 18 and 20 are substantially identical and are preferably fabricated of thermoplastic material. Each section 16, 18 or 20 includes (see FIGS. 1 and 13) a generally planar base plate 22. The base plate 22 has therein an opening 24 centered on the housing axis 14. Each section 16, 18 or 20 also includes (see FIGS. 1, 13 and 14) spaced flanges 26 projecting from one side of the base plate 22 at the opposite ends thereof, and four legs 28 projecting from the other side of the base plate 22 at the four corners thereof. The flanges 26 and the legs 28 have therein apertures 30 and 31, respectively. Each section 16, 18 or 20 also includes a cross member 32 extending between one pair of legs 28, and a cross member 32 extending between the other pair of legs 28. Each section 16, 18 or 20 further includes (see FIGS. 1, 4, 13 and 14) a mounting projection 34 located between the legs 28 at one end of the base plate 22, and a mounting projection 36 located between the legs 28 at the other end of the base plate 22. Preferably, as best shown in FIG. 4, the base plate 22 has therein a pocket 38 adjacent the mounting projection 34 and has therein a pocket 40 adjacent the mounting projection 36.

As shown in FIG. 1, the sections 16, 18 and 20 are stacked with the flanges 26 of the middle section 18 overlapping the legs 28 of the end section 16, and with the flanges 26 of the end section 20 overlapping the legs 28 of the middle section 18. The sections 16, 18 and 20 are secured to each other by nuts 41 and bolts 42 extending through the apertures 30 and 31 in the overlapping flanges 26 and legs 28.

The switch 10 also comprises (see FIGS. 1, 3 and 4) six fixed contact assemblies 44, with each contact assembly 44 being mounted on a respective one of the mounting projections 34 and 36. Each contact assembly 44 includes (see FIG. 4) contact portions 46 and 48, which are preferably stacks of copper shims. Each assembly 44 also includes means for maintaining a minimum spacing between the stacks of shims 46 and 48. While various suitable spacing means can be employed, in the preferred embodiment, such means include a copper spacer 50. One end of the spacer 50 extends between the stacks 46 and 48, and the other end of the spacer 50 provides a location for connecting a power line. Preferably, the shim stacks 46 and 48 are fixed to the spacer 50 by an eyelet 52, and the contact assembly 44 is secured to the associated mounting projection 34 or 36 by a screw 54 that extends through the eyelet 52 and that threadedly engages the associated mounting projection 34 or 36.

Each contact assembly also includes arc-resistant pads 55 secured to the inner surfaces of the shim stacks 46 and 48. Each of the pads 55 includes a contact tip or portion which engages the associated contact blade (described below) and which is fabricated of 70 percent tungsten and 30 percent copper. The pads 55 are spaced from each other when the shim stacks 46 and 48 are at their minimum spacing.

Each contact assembly 44 also includes (see FIG. 4) means for biasing the shim stacks 46 and 48 together or toward each other. While various suitable biasing means can be used, in the illustrated construction, such means includes a steel backing member or plate 56 abutting the outer surface of the shim stack 46, and a steel backing member or plate 58 abutting the outer surface of the shim stack 48. As mentioned previously, the steel plates 56 and 58 concentrate the magnetic flux of the contact assembly 44. The biasing means also includes means for biasing the backing members 56 and 58 toward each other. Preferably, the means for biasing the backing members 56 and 58 includes a post 60 extending through the members 56 and 58, the shim stacks 46 and 48 and the spacer 50. The post 60 has enlarged ends 62 and 64, and the means for biasing the backing members 56 and 58 also includes a compression spring 66 extending between the end 62 of the post 60 and a washer 68 engaging the steel plate 58. The end 64 of the post 60 engages the steel plate 56. The spring 66 acts through the washer 68 and the post 60 to bias the shim stacks 46 and 48 against the spacer 50 or toward each other. As shown in FIG. 4, the spring 66 is housed in the associated pocket 38 or 40. This protects the spring 66 from arcing.

Figure 2:
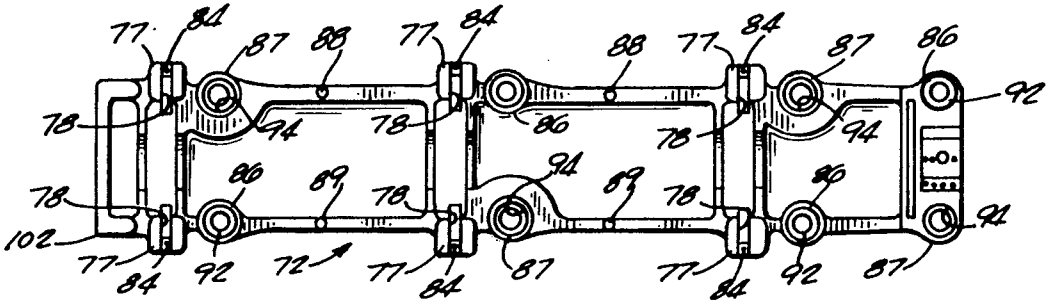
FIG. 2 is an elevational view of one of the shaft halves.
Figure 5:
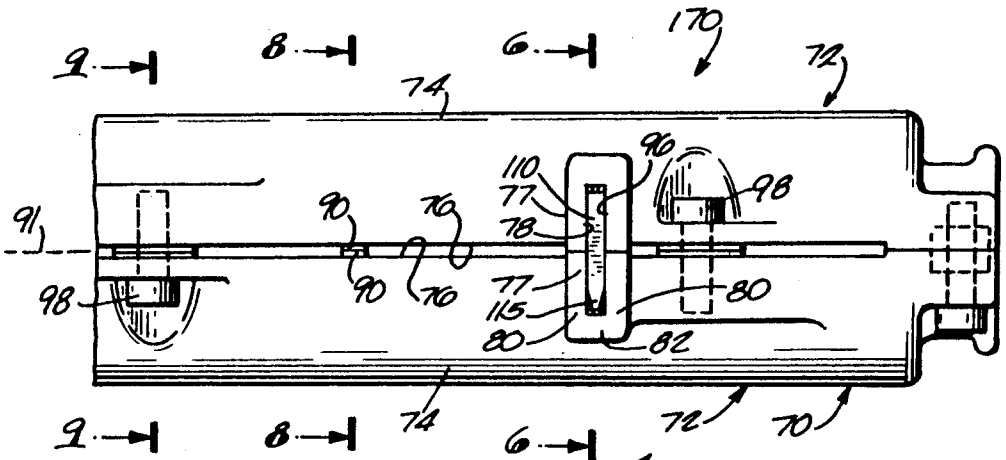
FIG. 5 is an enlarged, partial view of the shaft.
Figure 9:
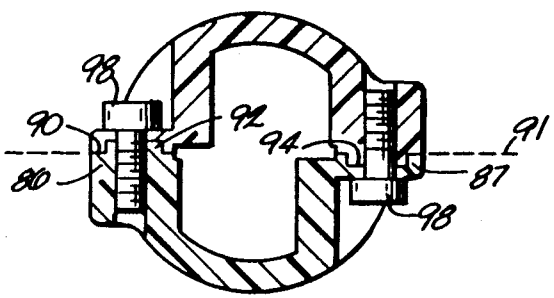
FIG. 9 is a view taken along line 9—9 in FIG. 5
Figure 8:
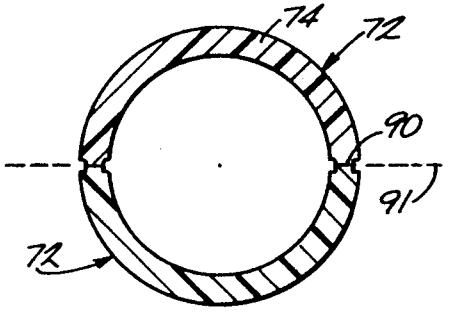
FIG. 8 is a view taken along line 8—8 in FIG. 5.

The switch also comprises (see FIGS. 1, 2 and 5–9) a shaft or rotor 70 supported by the housing 12 for pivotal movement relative thereto about the housing axis 14. The shaft 70 includes two substantially identical halves 72 fabricated of thermoplastic material. As shown in FIGS. 5 and 8, each half 72 includes a semicircular wall 74 having opposite ends. The ends of the wall 74 define a generally planar surface 76 which faces the corresponding surface 76 of the other half 72. The surface 76 has thereon (see FIG. 2) three aligned pairs of projections 77, each of which has therein a recess 78. Each recess 78 is defined by (see FIG. 5) opposed side walls 80 and an end wall 82, and the end wall 82 has thereon a crushable or deformable projection 84. The surface 76 also has thereon (see FIG. 2) at least four pairs of aligned projections 86 and 87 and at least two pairs of aligned projections 88 and 89. The projections 86–89 define (see FIGS. 5–9) a generally planar mating surface 90 that mates with the corresponding surface 90 of the other half 72 and that defines a plane 91 having therein the housing axis 14. In other words, the shaft 70 is split longitudinally or axially. Each projection 86 has thereon (see FIGS. 2 and 9) an annular projection 92, and each projection 87 has therein a circular recess 94.

As shown in FIGS. 5–9, the shaft halves 72 are aligned with each other so that each projection 86 abuts a projection 87 on the other half 72, with each recess 94 receiving a projection 92, so that each projection 88 abuts a projection 84, and so that each recess 78 is aligned with a recess 78 in the other half 72. The interengaging Projections 92 and recesses 94 prevent relative axial movement of the shaft halves 72. The aligned recesses 78 define (see FIG. 5) openings 96 in the shaft 70.

The shaft halves 72 are secured to each other by bolts or screws 98 (FIGS. 1, 5, 7 and 9) extending through aligned projections 86 and 87. Alternatively, the shaft halves 72 could be ultrasonically or otherwise welded together. Because the projections 86–89 are aligned and abut, the surfaces 76 are slightly spaced from each other, as shown in FIG. 5. This affords oil flow into and out of the shaft 70. Openings 100 (FIG. 1) in the shaft halves 72 are provided for the same reason. One end of the shaft 70 defines (see FIGS. 1, 2 and 13) an annular bearing surface 102 supported by base plate 22 of the end housing section 16. The other end of the shaft 70 has therein (see FIG. 7) a hexagonal opening 104. The opening 104 is defined by walls 106 having thereon projections 108.

Figure 3:
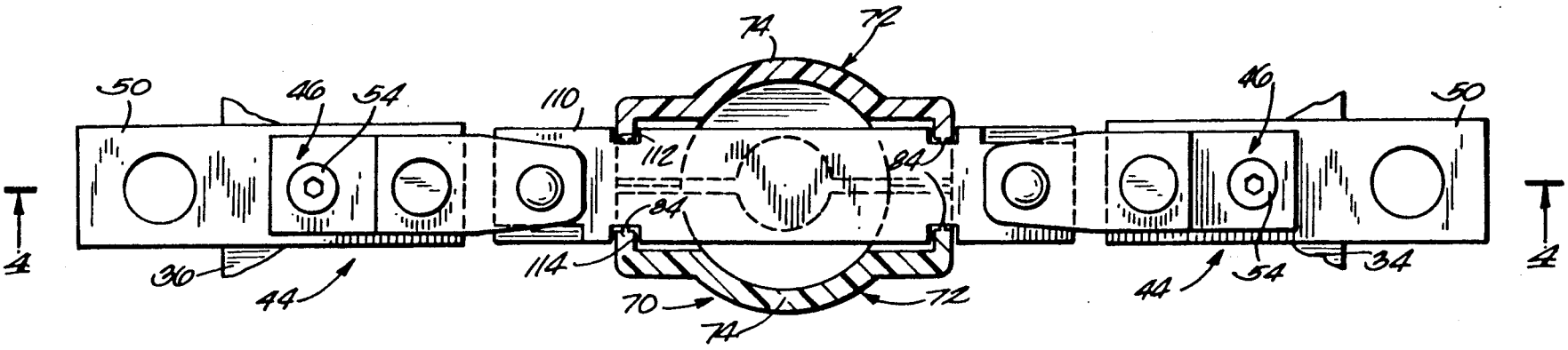
FIG. 3 is an enlarged view taken along line 3—3 in FIG. 1.
Figure 6:
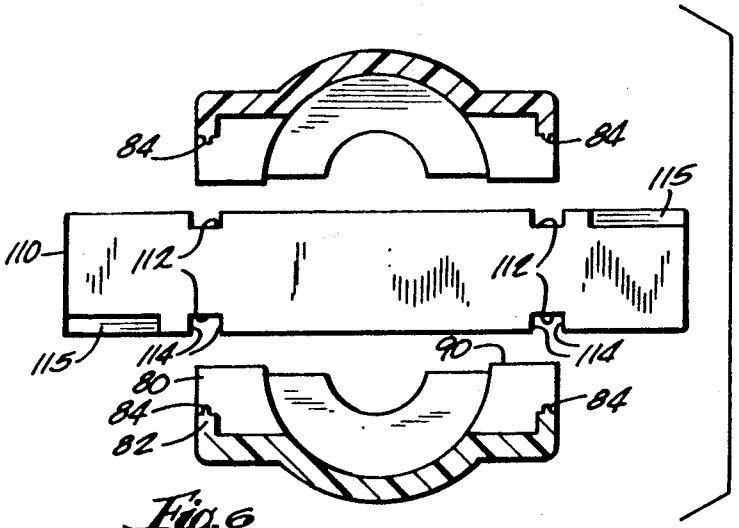
FIG. 6 is an exploded view taken along line 6—6 in FIG. 5.
Figure 7:
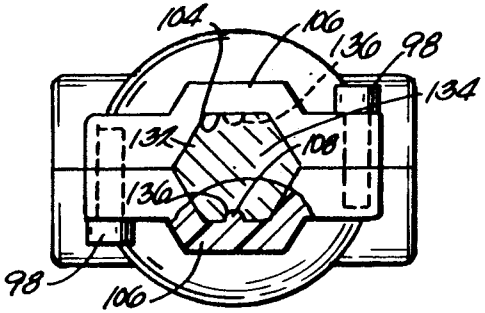
FIG. 7 is an enlarged view taken along line 7—7 in FIG. 1.

The switch 10 further comprises (see FIGS. 1 and 3–6) three movable contacts or contact blades 110 supported by the shaft 70 for pivotal movement therewith. Preferably, the contact blades 110 are made of chrome copper (CDA 182) so that the blades 110 retain their strength under arcing and are resistant to welding to the contact pads 55 under conditions of high fault current. As shown in FIGS. 5 and 6, each contact blade 110 is sandwiched or captured between the shaft halves 72 and extends through an opening 96 defined by an aligned pair of recesses 78, so that the opposite ends of the blade 110 extend outwardly of the rotor 70. Each blade 110 has therein (see FIGS. 3 and 6) recesses or notches 112 defined by opposed walls 114 which engage the shaft walls 74 to prevent movement of the blade 110 relative to the shaft 70. Furthermore, as shown in FIG. 3, when the blades 110 are "clamped" between the shaft halves 72, the deformable projections 84 are crushed against the blades 110 and thereby provide a tight fit between the blades 110 and shaft halves 72. This substantially prevents lateral movement of the blades 110 relative to the shaft 70. Additionally, as shown in the drawings, a substantial portion of each contact blade 110 is covered or surrounded by the rotor or shaft 70 so as to prevent an arc from traveling across the blade 110 and causing dielectric failure. Furthermore, each contact blade 110 includes means for facilitating separation of the contact portions 46 and 48 of the associated fixed contact assembly 44. While various suitable means can be employed, in the preferred embodiment, such means includes, on each end of each contact blade 110, a beveled portion 115.

The switch 10 further comprises (see FIGS. 1 and 10–12) means for pivotally moving the shaft 70 between a closed position (FIGS. 1, 3 and 4) in which each blade 110 engages a pair of contact assemblies 44 and an open position (not shown) in which the blades 110 are disengaged from the contact assemblies 44. As shown in FIG. 4, when the shaft 70 is in the closed position, the blades 110 separate the pads 55 a distance greater than their minimum separation so that the springs 66 are compressed. Preferably, the shaft 70 moves approximately 90° between the closed position and the open position. While various suitable moving means can be employed, in the preferred embodiment, such means includes (see FIG. 1) a motor assembly 116 including an inner motor plate 118 fixed to the legs 28 of the end housing section 20 by nuts 41 and bolts 42 extending through the apertures 31 of the housing section 20, and an outer plate 120 spaced from the inner plate 118 by spacers 122. The outer plate 120 and the spacers 122 are secured to the inner plate 118 by bolts 124. The outer plate 120 is preferably secured to the tank wall 126 of a transformer by suitable means such as bolts (not shown). The motor assembly 116 also includes (see FIG. 1) an input shaft 128 which is pivotably supported by the outer plate 120 and which extends through the tank wall 126. A gland/seal assembly 129 is sealingly secured to the tank wall 126, and the input shaft 128 extends through the gland/seal assembly 129. 0-rings 130 provide a seal between the shaft 128 and the assembly 129. The outer end of the input shaft 128 has fixed thereon a handle 131 adapted to be rotated by an operator so as to rotate the input shaft 128. The motor assembly 116 also includes (see FIG. 1) an output shaft 132 pivotably supported on the inner plate 118 by a bearing 133. The output shaft 132 has (see FIG. 7) a hexagonal inner end 134 housed in the opening 104 in the shaft 70, so that the output shaft 132 is effectively splined to the shaft 70. The inner end 134 of the output shaft 132 has therein depressions or recesses 136 that receive the projections 108 on the shaft halves 72, so that interengagement of the projections 108 and the recesses 136 prevents axial movement of the output shaft 132 relative to the shaft 70.

Figure 10:
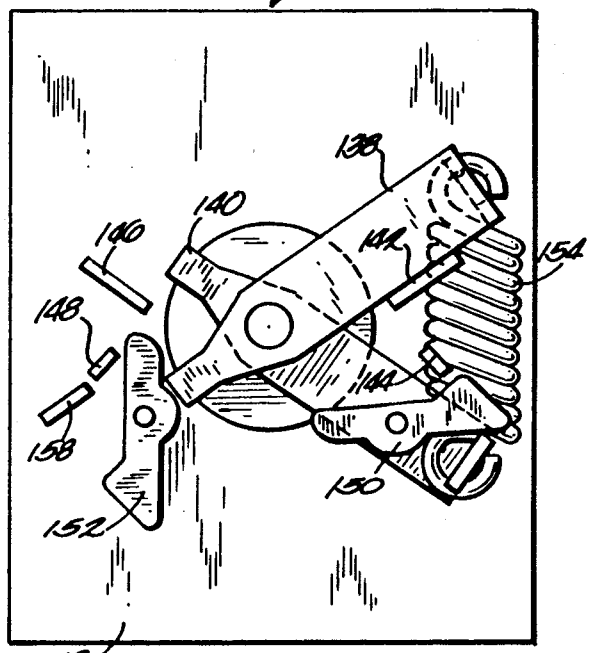
FIG. 10 is a view taken along line 10—10 in FIG. 1.
Figure 11:
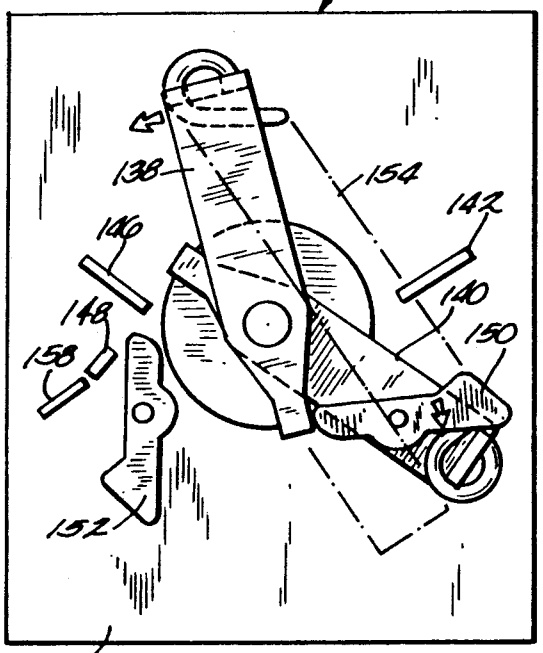
FIGS. 11 and 12 are views which are similar to FIG. 10 and which illustrate operation of the motor assembly.
Figure 12:
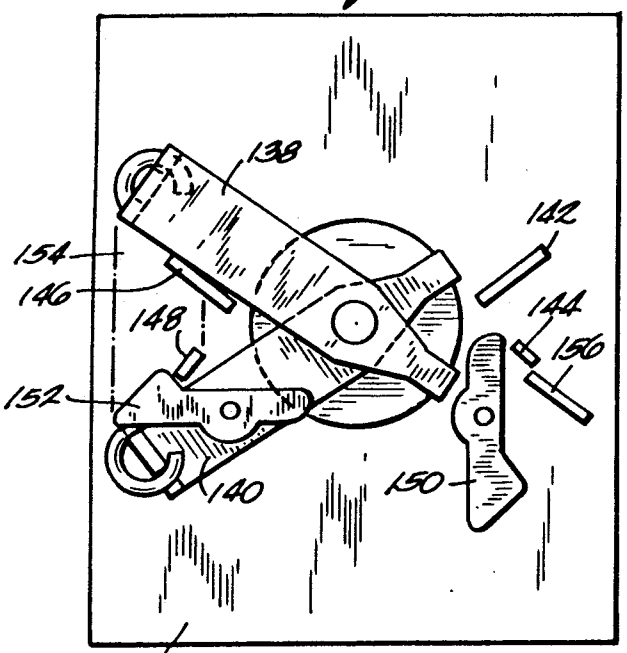

The motor assembly 116 also includes means for converting pivotal movement of the input shaft 128 into a "snap action" pivotal movement of the output shaft 132. Preferably, this means includes (see FIGS. 1 and 10–12) an L-shaped outer lever 138 fixed to the input shaft 128 for common movement therewith, and an L-shaped inner lever 140 fixed to the output shaft 132 for common movement therewith. This means further includes (see FIGS. 10–12) stops 142, 144, 146 and 148 extending inwardly from the outer plate 120, cam members 150 and 152 pivotally mounted on the outer plate 120, a spring 154 extending between the levers 138 and 140, and stops 156 and 158 extending outwardly from the inner plate 118. When the switch 10 is closed, as shown in FIG. 10, the spring 154 biases the inner lever 140 against the stop 156 and biases the outer lever 138 against the stop 142. Also, the cam member 150 is trapped between the lever 140 and the stop 144 and the cam member 152 is trapped between the lever 138 and the stop 148. To open the switch 10, the input shaft 128 and the outer lever 138 are rotated counterclockwise (as shown in FIGS. 10–12). This moves the outer lever 138 away from the stop 142 and extends the spring 154. When the outer lever 138 reaches the position shown in FIG. 11, the lower end (as shown in FIG. 11) of the outer lever 138 engages the cam member 150 and pivots the cam member 150 clockwise and into engagement with the inner lever 140. Engagement of the inner lever 140 by the cam member 150 pivots the inner lever 140 clockwise, but not far enough to separate the blades 110 from the contact assemblies 44. Before such separation occurs, the spring 154 passes over the center line of the inner lever 140, after which the spring 154 biases the inner lever 140 clockwise and biases the outer lever 138 counterclockwise. This causes a snap action of the levers 138 and 140 to the positions shown in FIG. 12, wherein the inner lever 140 rests against the stop 158, the outer lever 138 rests against the stop 146, the cam member 150 is trapped between the lever 138 and the stop 144, and the cam member 152 is trapped between the lever 140 and the stop 148. The snap action of the inner lever 140 to the position shown in FIG. 12 moves the shaft 70 to the open position and thereby separates the blades 110 from the contact assemblies 44.

Operation of the motor assembly 116 to close the switch 70 is the reverse of the above, except that the outer lever 138 engages the cam member 152, and the cam member 152 engages the inner lever 140 to cause initial movement of the inner lever 140.

The switch 70 is assembled as follows. First, the contact blades 110 are sandwiched between the shaft halves 72, and the shaft halves 72 are secured to each other by the screws 98. When the screws 98 are tightened, the deformable Projections 84 are crushed against the blades 110 to provide a tight fit between the shaft 70 and the blades 110. When the shaft halves 72 are placed together to capture the contact blades 110, the shaft halves 72 are concurrently placed over the inner end 134 of the output shaft 132 so that the shaft halves 72 capture the inner end 134 of the output shaft 132 and the projections 108 on the shaft halves 72 are received in the depressions 136 in the output shaft 132. Thus, the shaft 70 and the contact blades 110 are assembled to provide a shaft and contact assembly 170, which assembly 170 is connected to the motor assembly 116.

Next, the housing sections 16, 18 and 20 are placed over the shaft 70. In other words, the housing sections 16, 18 and 20 are located in surrounding relation to the shaft and contact assembly 170. This is done by passing the shaft and contact assembly 170 through the openings 24 in the base plates 22 of the housing sections 16, 18 and 20.

Next, the bolts 42 are placed in the apertures 30 and 31 but the nuts 41 are not tightened. The apertures 31 are slightly larger than the bolts 42 so that some adjustment of the relative position of the housing sections 16, 18 and 20 and the plate 118 is possible.

Next, the shaft 70 is moved to the closed position relative to the motor assembly 116 and the contact blades 110 are placed in engagement with their respective fixed contact assemblies 44. This properly aligns the housing sections 16, 18 and 20 relative to the shaft and contact assembly 170.

Next, the shaft and contact assembly 170 is secured relative to the housing sections 16, 18 and 20. This is done by securing the end housing section 20 to the inner plate 118 by tightening the nuts 41 on the bolts 42 connecting the plate 118 to the housing section 20, by securing the middle housing section 18 to the end housing section 20 by tightening the nuts 41 on the bolts 42 connecting the sections 18 and 20, and by securing the end housing section 16 to the middle housing section 18 by tightening the nuts 41 on the bolts 42 connecting the sections 16 and 18. Alternatively stated, the housing sections are secured to the shaft and contact assembly 170 by securing the housing sections 16, 18 and 20 relative to the motor assembly 116.

This method of assembly permits the housing sections 16, 18 and 20 to be properly aligned with the shaft and contact assembly 170. This in turn substantially assures that the contact blades 110 will properly engage the fixed contact assemblies 44, i.e., that the contact blades 110 will engage the pads 55 equally, when the shaft 70 is moved to the closed position.

Various features of the invention are set forth in the following claims.

We claim:

1. A switch apparatus comprising a housing, a first contact supported by said housing, a shaft supported by said housing for rotation relative thereto about a longitudinal axis, said shaft including opposite halves mating along a longitudinally extending plane, a second contact supported by said shaft for common movement therewith, and means for moving said shaft relative to said housing and about said axis between a closed position wherein said second contact engages said first contact and an open position wherein said second contact is spaced from said first contact.

2. An apparatus as set forth in claim 1 wherein said second contact is sandwiched between said shaft halves.

3. An apparatus as set forth in claim 2 wherein said shaft includes means for preventing movement of said contact relative to said shaft.

4. An apparatus as set forth in claim 3 wherein said means for preventing movement includes, on each of said shaft halves, a deformable projection engaging said second contact.

5. An apparatus as set forth in claim 1 wherein said shaft halves are substantially indentical.

6. An apparatus as set forth in claim 1 wherein said shaft is fabricated of thermoplastic material.

7. An apparatus as set forth in claim 1 wherein said shaft is fabricated of dielectric material and surrounds a substantial portion of said second contact.

8. A switch apparatus as set forth in claim 1 and further comprising a third contact supported by said housing, and wherein said second contact bridges said first and third contacts when said shaft is in said closed position.

9. A switch apparatus as set forth in claim 1 wherein said shaft halves are made of dielectric material.

10. A switch apparatus comprising a housing having therein a pocket, a shaft supported by said housing for pivotal movement relative thereto, a contact assembly supported by said housing and including a first contact portion, a second contact portions and means for biasing said first and second contact portions toward each other, said biasing means including a spring housed in said pocket such that said spring is surrounded by said housing so that said spring is protected from arcing, a contact blade supported by said shaft for common movement therewith, and means for moving said shaft relative to said housing between a closed position wherein said blade extends between said contact portions and an open position wherein said blade is spaced from said contact portions.

11. A switch apparatus as set forth in claim 10 wherein said contact blade includes means for facilitating separation of said contact portions.

12. A switch apparatus as set forth in claim 11 wherein said contact blade includes a beveled portion, and wherein said means for facilitating separation includes said beveled portion.

13. A switch apparatus comprising a housing, a pair of spaced, fixed contact assemblies supported by said housing, each of said fixed contact assemblies including a first contact portion, a second contact portion, and means for biasing said contact portions toward each other, a shaft fabricated of dielectric material and supported by said housing for rotation relative thereto about an longitudinal axis extending between said fixed contacts, said shaft including opposite halves mating along a longitudinally extending plane, a movable contact blade which has opposite ends and which is sandwiched between said shaft halves such that said ends extend outwardly of said shaft and such that said shaft halves surround a substantial portion of said movable contact blade, and means for moving said shaft relative to said housing and about said axis between a closed position wherein said movable contact blade engages said contact portions of said fixed contact assemblies and an open position wherein said movable contact blade is spaced from said fixed contact assemblies.

14. A switch apparatus as set forth in claim 13 wherein each of said contact portions has thereon an arc-resistant pad fabricated of a combination of tungsten and copper, wherein said movable contact blade engages said pads when said shaft is in said closed position, and wherein said movable contact blade is fabricated of chrome copper.

15. A switch apparatus comprising a housing, a pair of spaced, fixed contact assemblies supported by said housing, each of said fixed contact assemblies including a first contact portion, a second contact portion, and means for biasing said contact portions toward each other, a shaft fabricated of dielectric material and supported by said housing for rotation relative thereto about an axis extending between said fixed contacts, said shaft including opposite halves mating along a longitudinally extending plane, a movable contact blade which has opposite ends and which is sandwiched between said shaft halves such that said ends extend outwardly of said shaft such that said shaft halves surround a substantial portion of said movable contact blade, means for preventing movement of said movable contact blade relative to said shaft, said means for preventing movement including, on each of said shaft halves, a deformable projection engaging said movable contact blade, and means for moving said shaft relative to said housing about said axis between a closed position wherein said movable contact blade engages said contact portions of said fixed contact assemblies and an open position wherein said movable contact blade is spaced from said fixed contact assemblies.

16. an apparatus as set forth in claim 15 wherein said shaft halves are substantially identical.

17. A switch apparatus comprising a housing, a first contact array including a first contact supported by said housing, a shaft supported by said housing for rotation relative thereto about a longitudinal axis, said shaft including opposite halves mating along a longitudinally extending plane, a second contact supported by said shaft for common movement therewith, and means for moving said shaft relative to said housing and about said axis between a closed position wherein said second contact engages said first contact and an open position wherein said second contact is spaced from said first contact.

18. A switch apparatus as set forth in claim 17 wherein said shaft halves are made of dielectric material.

19. An apparatus as set forth in claim 17 wherein said second contact is sandwiched between said shaft halves.

20. An apparatus as set forth in claim 17 wherein said shaft halves are substantially identical.

* * * * *